US009466933B1

(12) United States Patent
Wang

(10) Patent No.: US 9,466,933 B1
(45) Date of Patent: Oct. 11, 2016

(54) ANTI-LOOSENING ELECTRIC CONNECTOR MOUNTING STRUCTURE

(71) Applicant: ADLINK TECHNOLOGY INC., New Taipei (TW)

(72) Inventor: Jhih-Hong Wang, New Taipei (TW)

(73) Assignee: ADLINK TECHNOLOGY INC., New Taipei (TW)

( * ) Notice: Subject to any disclaimer, the term of this patent is extended or adjusted under 35 U.S.C. 154(b) by 0 days.

(21) Appl. No.: 14/961,147

(22) Filed: Dec. 7, 2015

(51) Int. Cl.
*H01R 25/00* (2006.01)

(52) U.S. Cl.
CPC ..... *H01R 25/006* (2013.01)

(58) Field of Classification Search
CPC ..... H01R 25/006; H01R 13/6273; H01R 13/6272; H01R 13/6485
USPC ..... 439/558, 557, 529, 555; 248/27.1, 27.3
See application file for complete search history.

(56) References Cited

U.S. PATENT DOCUMENTS 1,110,163 A * 9/1914 Thomas ..... F21V 19/006 439/555
1,171,180 A * 2/1916 Despard ..... H01R 13/743 362/432
3,555,486 A * 1/1971 Teagno ..... H01R 13/6272 439/357
4,668,040 A * 5/1987 Matsuzaki ..... H01R 12/7029 439/557
4,711,507 A * 12/1987 Noorily ..... H01R 13/6273 29/869
5,122,076 A * 6/1992 Pitts ..... H01R 13/6273 439/347
6,123,575 A * 9/2000 Huang ..... H01R 13/6273 439/352
6,361,363 B1 * 3/2002 Hwang ..... H01R 13/6485 439/352
6,893,168 B2 * 5/2005 Huang ..... G02B 6/4246 361/728
7,311,545 B2 * 12/2007 Wu ..... H01R 13/6275 439/358
7,824,206 B1 * 11/2010 Wilson ..... H01R 13/6275 439/350
9,076,498 B1 * 7/2015 Kuo ..... G11B 33/124
2003/0124907 A1 * 7/2003 Ushiro ..... H01R 13/743 439/557
2006/0094293 A1 * 5/2006 Daggett ..... H01R 13/6273 439/544

* cited by examiner

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

A data storage device mounting structure includes a housing having electric connector mounting slots located in the peripheral wall thereof, electric connectors respectively detachably mounted in the electric connector mounting slots and electrically connected to a circuit board inside the housing by respective electrical wires, each electric connector having two retaining arms suspended from two opposite lateral walls thereof and a retaining space defined between each lateral wall and one respective retaining arm, and retainers respectively set in the retaining spaces to lock up the electric connectors in the respective electric connector mounting slots, each retainer having a C-shaped retainer body engaged into one respective retaining space and two finger tips respectively extended from two opposite ends of the C-shaped retainer body and stopped at the outer surface of the peripheral wall of the housing around the respective electric connector mounting slot.

5 Claims, 6 Drawing Sheets

ANTI-LOOSENING ELECTRIC CONNECTOR MOUNTING STRUCTURE

BACKGROUND OF THE INVENTION

1. Field of the Invention

The present invention relates to electric connector mounting technology and more particularly, to an anti-loosening electric connector mounting structure, which has two retainers detachably inserted in respective retaining spaces at two opposite lateral sides of an electric connector to lock up the electric connector in an electric connector mounting slot of a housing, facilitating mounting and dismounting of the electric connector.

2. Description of the Related Art

With fast development of technology, advanced electronic and electrical devices have been continuously created for various applications, including clothing, food, housing and entertainment. In offices and work places, various office machines are used to help people process paperwork, video images or photos. The use of advanced electronic and electrical devices and office machines bring convenience and comfort to our lives and works and enhance our working efficiency. These devices and machines have become indispensible tools in our daily lives. Further, electric connectors widely used for transmission of electronic signals and/or power between electric and electronic devices and related peripheral apparatuses to achieve software program implementation and data access operations. Screws are commonly used to affix electric connectors to the housings of electric or electronic devices. There are certain electric connectors configured to provide elastic retaining members at the electrically insulative outer shell thereof for hooking in the housing of an electric or electronic device, facilitating mounting and dismounting. These elastic retaining members can positively secure the electric connectors to the housing of the electric or electronic device, however when the electric or electronic device is being delivered, moved, or impacted, the elastic retaining members can easily be loosened or forced out of place, causing the electric connectors to fall from the housing of the electric or electronic device. If the electric connectors fall from the housing of the electric or electronic device, the user needs to open the housing and then mount the electric connectors in the housing again, causing you so much trouble and inconvenience.

Therefore, there is a strong demand for a measure that facilitates mounting and dismounting of electronic connectors and effectively prohibits installed electronic connectors from loosening.

SUMMARY OF THE INVENTION

The present invention has been accomplished under the circumstances in view. It is therefore one object of the present invention to provide an anti-loosening electric connector mounting structure, which facilitates mounting and dismounting of the electric connector and prohibits the installed electric connector from loosening.

To achieve this and other objects of the present invention, an anti-loosening electric connector mounting structure comprises a housing, which has a plurality of electric connector mounting slots located in a peripheral wall thereof, electric connectors respectively detachably mounted in the electric connector mounting slots and electrically connected to a circuit board in the housing by respective electrical wires, each electric connector having two retaining arms suspended from two opposite lateral walls thereof and a retaining space defined between each lateral wall and one respective retaining arm, and retainers respectively and elastically deformably set in the retaining spaces to lock up the electric connectors in the respective electric connector mounting slots. Each retainer comprises a C-shaped retainer body engaged into one respective retaining space to force the respective retaining arm of the electric connector into positive engagement with the outer surface of the peripheral wall of the housing, and two finger tips respectively extended from two opposite ends of the C-shaped retainer body and stopped at the outer surface of the peripheral wall of the housing around the respective electric connector mounting slot.

Further, the retainers are a-shaped resilient wire rod members, each further comprising two curved arm portions respectively connected between two opposite ends of the C-shaped retainer body and the two finger tips and a narrow access gap defined between said two curved arm portions. Further, the combined length between respective distal ends of the two finger tips of each retainer is larger than the vertical height of the two retaining arms of each electric connectors and the vertical height of the electric connector mounting slots of the housing.

DETAILED DESCRIPTION OF THE PREFERRED EMBODIMENT

Figure 1:
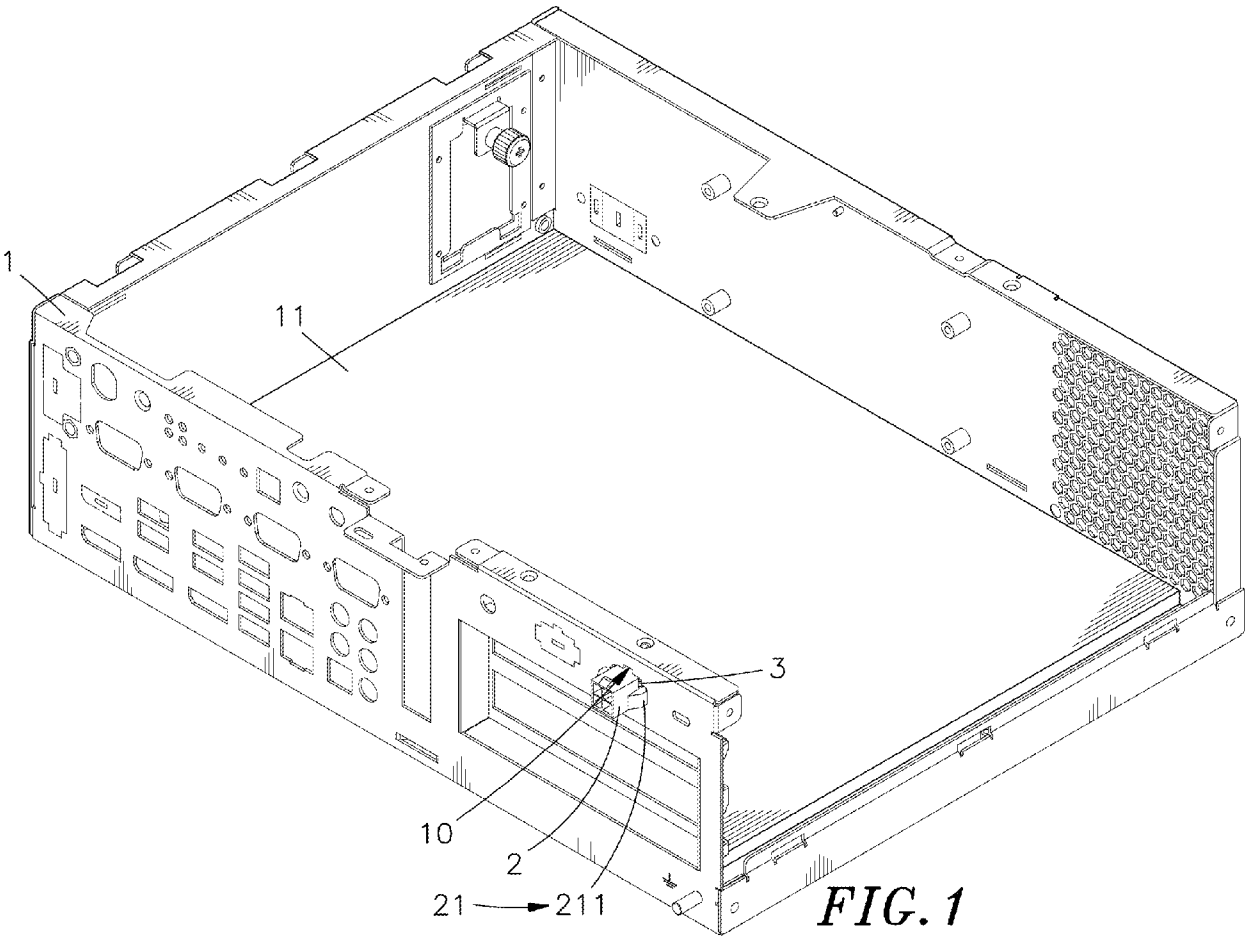
FIG. 1 is an oblique top elevational view of an anti-loosening electric connector mounting structure in accordance with the present invention.
Figure 2:
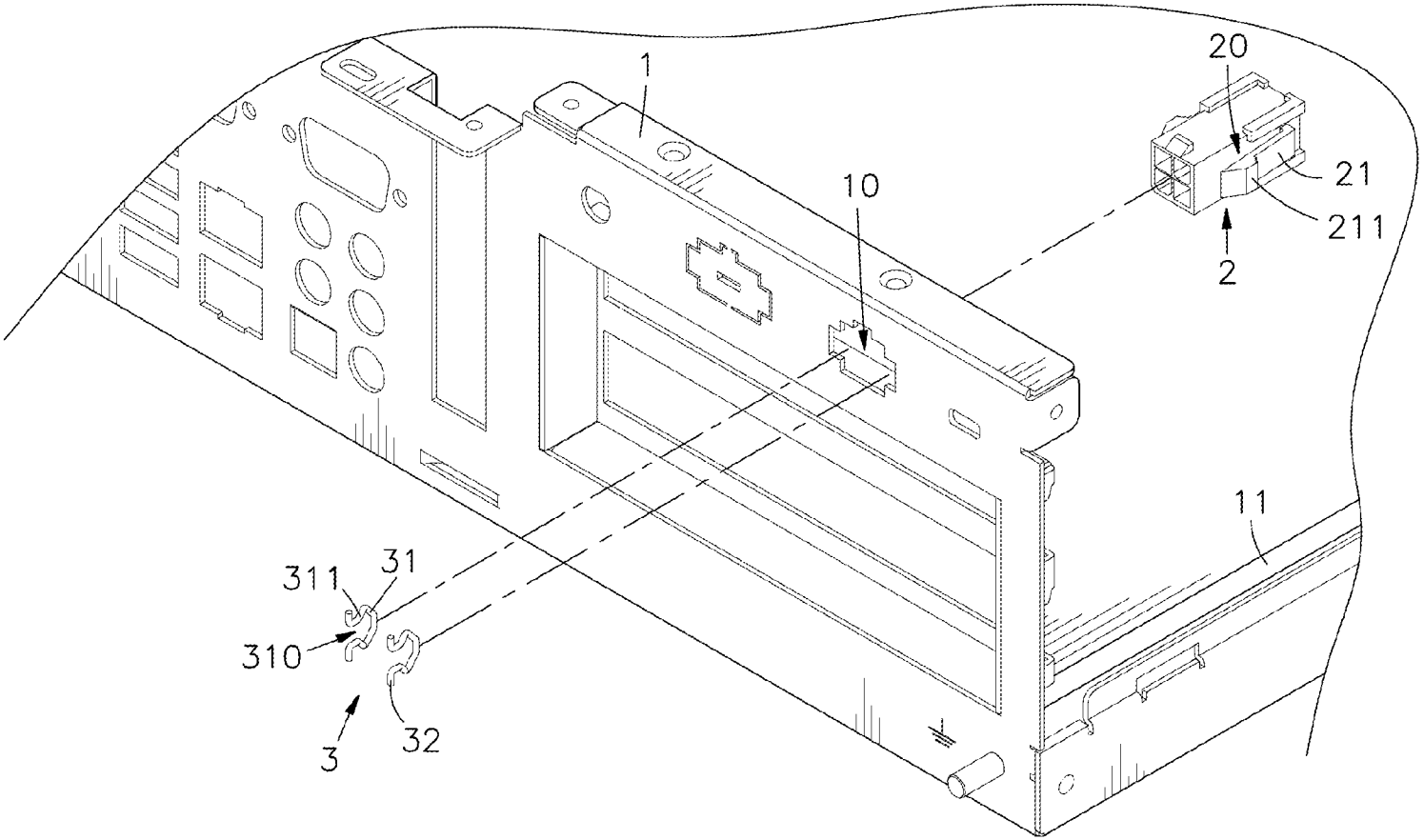
FIG. 2 is an exploded view of the anti-loosening electric connector mounting structure in accordance with the present invention.
Figure 3:
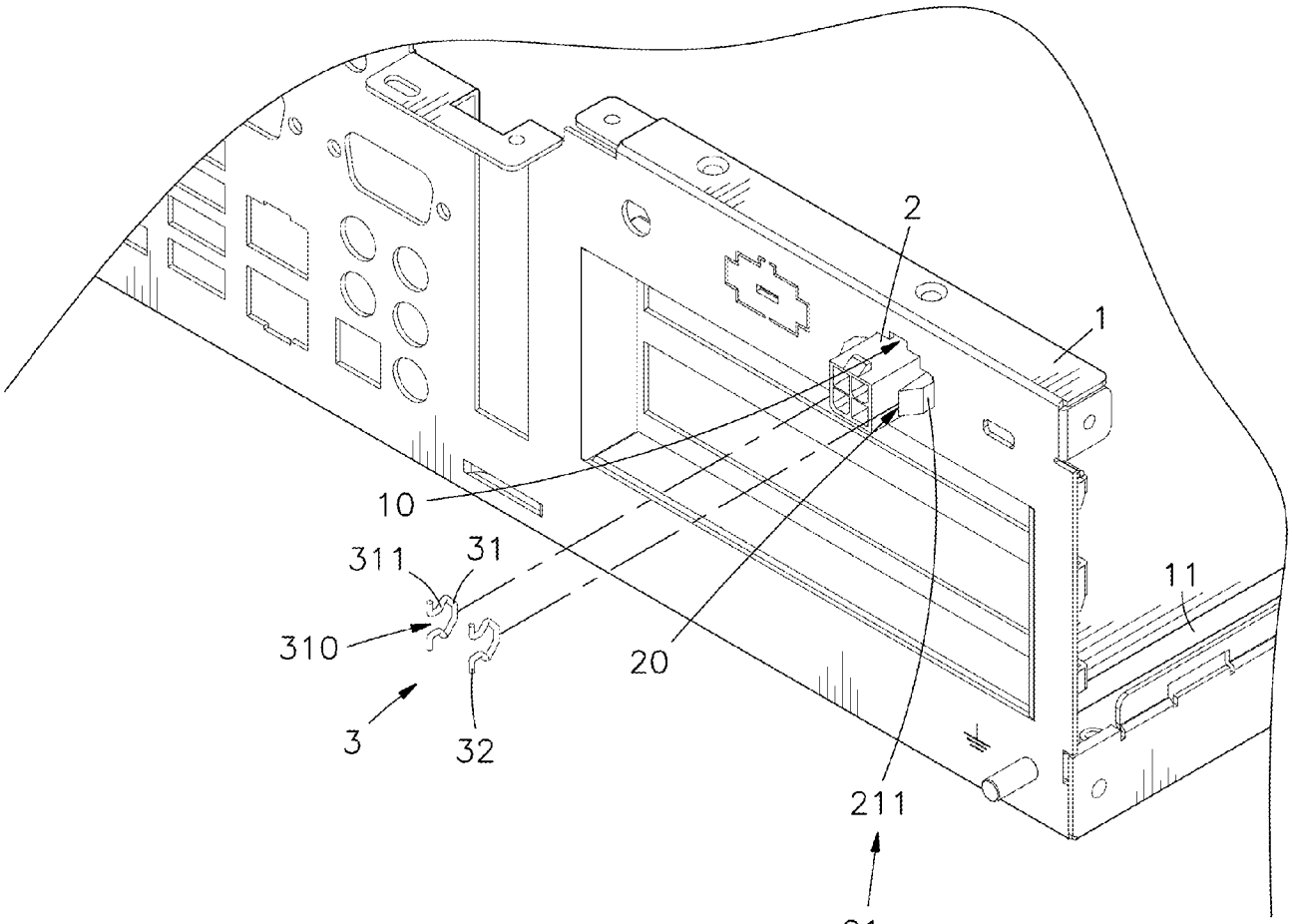
FIG. 3 corresponds to FIG. 2, illustrating the electric connector mounted in one electric connector mounting slot of the housing.
Figure 4:
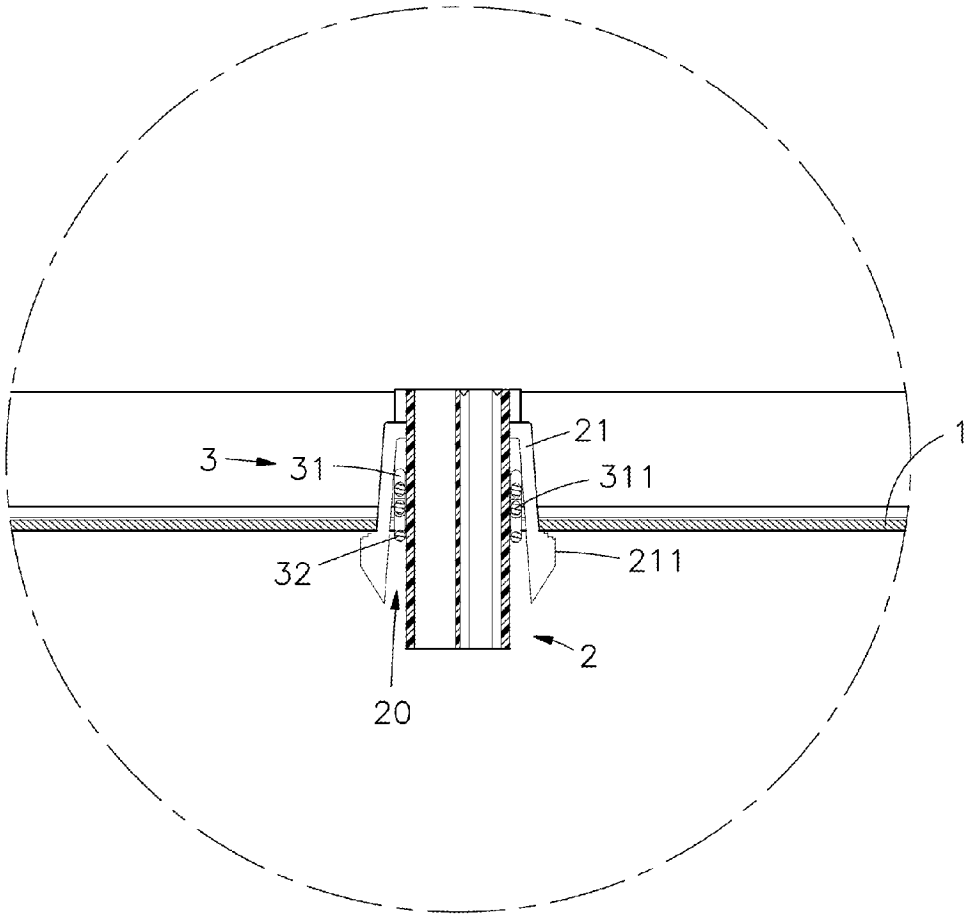
FIG. 4 is a sectional top view of the invention, illustrating

Referring to FIGS. 1-4, an anti-loosening electric connector mounting structure in accordance with the present invention is shown. The anti-loosening electric connector mounting structure comprises a housing 1, one or a plurality of electric connectors 2, and a plurality of retainers 3.

The housing 1 is a frame case for an electronic or electrical apparatus, having mounted therein a circuit board 11. Further, the housing 1 comprises a plurality of electric connector mounting slots 10 located in the peripheral wall thereof for the mounting of the electric connectors 2. After installation of the electric connectors 2 in the respective electric connector mounting slots 10, the electric connectors 2 are respectively electrically connected to the circuit board 11 in the housing 1 by respective electrical wires (not shown) for signal and/or power transmission between the electric connectors 2 and the circuit board 11. Each electric connector 2 comprises two retaining arms 21 respectively suspended from two opposite lateral walls thereof and respectively terminating in a respective barbed hook portion 211, and a retaining space 20 defined between each lateral wall and the associating retaining arm 21.

The retainers 3 are a-shaped resilient wire rod members, each comprising a substantially C-shaped retainer body 31, two curved arm portions 311 respectively extended from two opposite ends of the C-shaped retainer body 31, a narrow access gap 310 defined between the two curved arm portions 311, and two finger tips 32 respectively outwardly extended from the curved arm portions 311 remote from the C-shaped retainer body 31 in reversed directions. Further, when the retainer 3 is extended out without pressure, the combined length between the distal ends of the two finger tips 32 is larger than the vertical height of the retaining arms 21 of the electric connectors 2 and the vertical height of the electric connector mounting slots 10 of the housing 1.

In installation, the electric connectors 2 are respectively inserted into the respective electric connector mounting slots 10 of the housing 1 in direction from the space inside the housing 1 toward the space outside the housing 1. When inserting one electric connector 2 into one respective electric connector mounting slot 10 of the housing 1 from the inside the housing 1 toward the outside thereof, the barbed hook portions 211 of the retaining arms 21 are squeezed inwards to reduce the respective retaining spaces 20 for passing through the respective electric connector mounting slot 10. After passed the electric connector mounting slot 10, the barbed hook portions 211 of the retaining arms 21 immediately return to their former shape subject to the effect of the elastic material property of the retaining arms 21, and thus, the barbed hook portions 211 are respectively hooked on the peripheral wall of the housing 1 around the electric connector mounting slot 10. At this time, insert two retainers 3 from the outside of the housing 1 into the respective retaining spaces 20 between the two opposite lateral walls of the electric connector 2 and the retaining arms 21 to squeeze the curved arm portions 311 of each retainer 3 in narrowing the respective narrow access gap 310 and to force the C-shaped retainer bodies 31 and curved arm portions 311 of the retainers 3 through the respective electric connector mounting slot 10. Thereafter, release the pressure from the retainers 3, enabling the retainers 3 to return the respective C-shaped retainer bodies 31 and curved arm portions 311 into their former shapes. At this time, the finger tips 32 of the retainers 3 are stopped at the peripheral wall of the housing 1 around the respective electric connector mounting slot 10, and the C-shaped retainer bodies 31 and curved arm portions 311 of the retainers 3 are engaged in the respective retaining spaces 20 to stop the retaining arms 21 of the electric connector 2 from being squeezed inwards, and thus, the electric connector 2 is locked up in the respective electric connector mounting slot 10 of the housing 1, preventing loosening, displacement or falling. When the housing 1 is being delivered, moved, or impacted, the positioning of the retainers 3 in the respective retaining spaces 20 keep the respective electric connectors 2 in positive engagement in the respective electric connector mounting slot 10, prohibiting the electric connectors 2 from falling out of the housing 1. Further, the procedure of the installation of the electric connector 2 in the housing 1 is quite simple and convenient.

Figure 5:
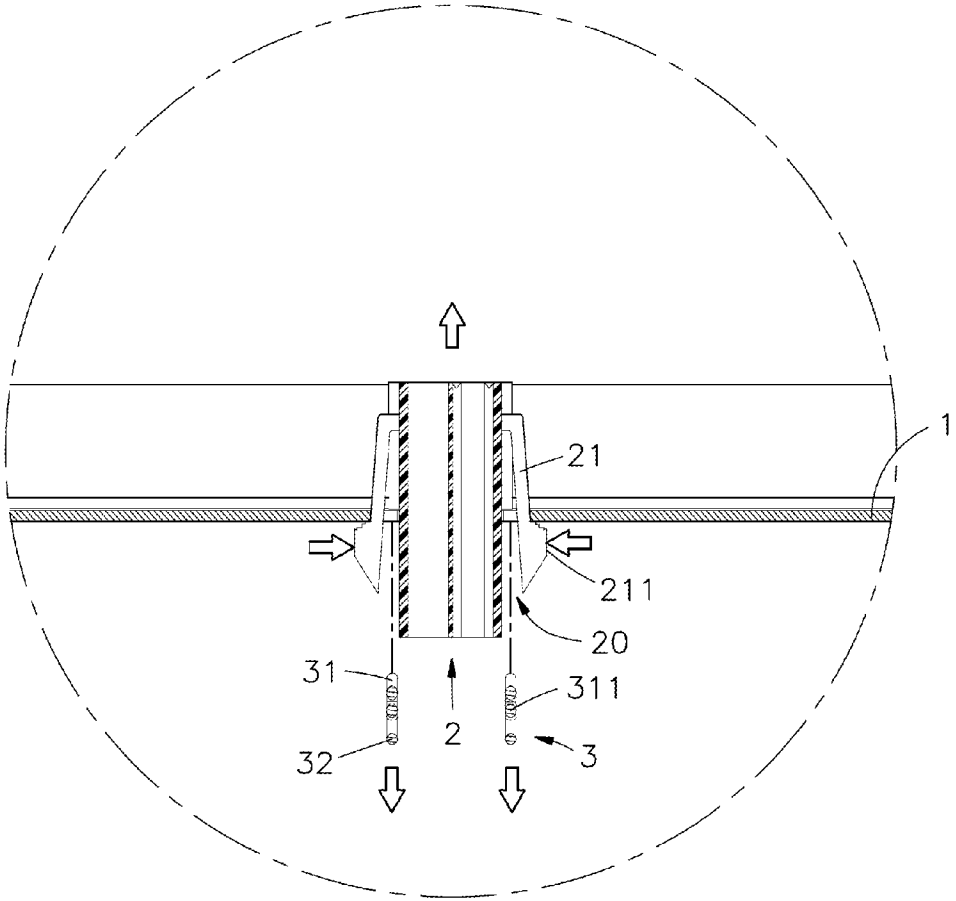
FIG. 5 is a schematic sectional top view illustrating the electric connector dismounting operation.
Figure 6:
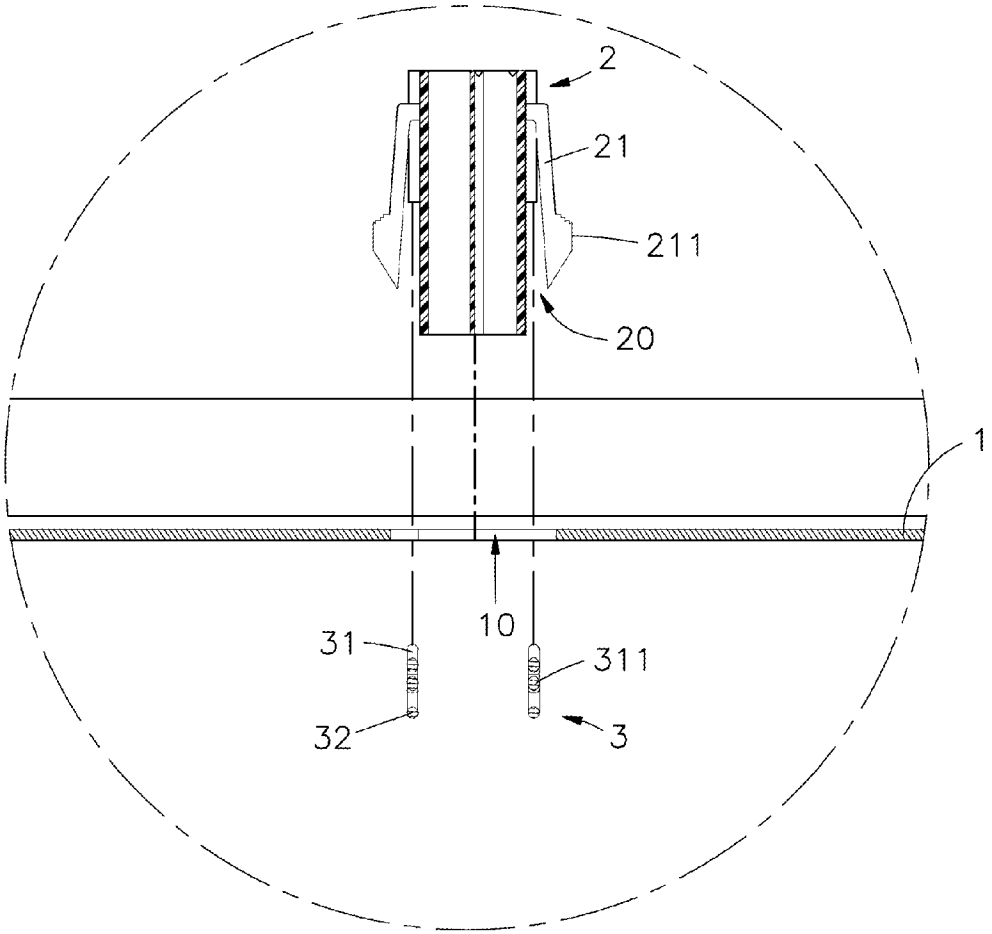
FIG. 6 corresponds to FIG. 5, illustrating the electric connector and the retainers removed from the housing.

Referring to FIGS. 5 and 6 and FIGS. 2 and 4 again, when wishing to remove each electric connector 2 from the respective electric connector mounting slot 10 of the housing 1, squeeze the finger tips 32 of the respective two retainers 3 to narrow the respective narrow access gaps 310 and to elastically deform the C-shaped retainer bodies 31 and curved arm portions 311 of the respective two retainers 3 for allowing removal of the respective retainers 3 out of the respective retaining spaces 20 of the electric connector 2. After removal of the two retainers 3 from the respective retaining spaces 20 of the electric connector 2 and the housing 1, squeeze the two retaining arms 21 of the electric connector 2 to narrow the respective retaining spaces 20 and then push the electric connector 2 inwardly toward the inside of the housing 1 to move the two retaining arms 21 and the respective barbed hook portions 211 inwardly out of the electric connector mounting slot 10, and thus, the electric connector 2 is dismounted from the housing 1. Thus, the procedure of dismounting the electric connector 2 from the housing 1 is quite simple.

It is to be understood that the above-described preferred embodiment of the present invention is simply for the purpose of illustration only but not intended for use to limit the scope and spirit of the present invention. As stated above, in the anti-loosening electric connector mounting structure, the housing 1 comprises a plurality of the electric connector mounting slots 10 for the mounting of the electric connectors 2. After insertion of the electric connectors 2 into the respective electric connector mounting slots 10 the barbed hook portions 211 of the retaining arms 21 of the electric connectors 2 are respectively hooked on the outer surface of the peripheral wall of the housing 1 around the respective electric connector mounting slots 10, and then the retainers 3 are respectively inserted into the respective retaining spaces 20 at two opposite lateral sides of the respective electric connectors 2 with the finger tips 32 of the respective retainers 3 protruded over the opposing top and bottom sides of the respective retaining arms 21 of the respective electric connectors 2 and stopped at the outer surface of the peripheral wall of the housing 1 around the respective electric connector mounting slots 10 to lock up the respective electric connectors 2 in the respective electric connector mounting slots 10 of the housing 1. By means of squeezing the finger tips 32 to elastically deform the respective retainers 3, the retainers 3 can easily be removed from the respective retaining spaces 20 of the respective electric connectors 2 to unlock the respective electric connectors 2, allowing squeezing of the retaining arms 21 and removal of the respective electric connectors 2 from the respective electric connector mounting slots 10 of the housing 1.

In conclusion, the invention provides an anti-loosening electric connector mounting structure, which comprises a housing having a plurality of electric connector mounting slots located in a peripheral wall thereof, a plurality of electric connectors respectively detachably mounted in the electric connector mounting slots, each electric connector having two retaining arms suspended from two opposite lateral walls thereof and a retaining space defined between each lateral wall and one respective retaining arm, and retainers respectively set in the retaining spaces to lock up the electric connectors in the respective electric connector mounting slots. Squeezing respective finger tips of the retainers to elastically deform the retainers allows removal of the retainers from the respective electric connector to unlock the respective electric connectors, facilitating quick removal of the electric connectors from the respective electric connector mounting slots of the housing.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An anti-loosening electric connector mounting structure, comprising a housing having a plurality of electric connector mounting slots located in a peripheral wall thereof, and a plurality of electric connectors respectively and detachably mounted in said electric connector mounting slots, each said electric connector comprising two retaining arms respectively suspended from two opposite lateral walls thereof and respectively hooked on an outer surface of said peripheral wall of said housing around the respective said electric connector mounting slot, wherein each said electric connector comprises two retaining spaces respectively defined between the two opposite lateral walls thereof and the respective said retaining arms; the anti-loosening electric connector mounting structure further comprises a plurality of retainers respectively inserted into each said retaining space to force the respective said retaining arms into positive engagement with the outer surface of said peripheral wall of said housing, each said retainer comprising a C-shaped retainer body detachably engaged into one respective said retaining space and two finger tips respectively extended from said C-shaped retainer body at two opposite sides and stopped at the outer surface of said peripheral wall of said housing.

2. The anti-loosening electric connector mounting structure as claimed in claim 1, wherein said retainers are Ω-shaped resilient wire rod members, each further comprising two curved arm portions respectively connected between two opposite ends of said C-shaped retainer body and said two finger tips and a narrow access gap defined between said two curved arm portions.

3. The anti-loosening electric connector mounting structure as claimed in claim 1, wherein the combined length between respective distal ends of said two finger tips of each said retainer is larger than the vertical height of said two retaining arms of each said electric connectors.

4. The anti-loosening electric connector mounting structure as claimed in claim 1, wherein the combined length between respective distal ends of said two finger tips of each said retainer is larger than the vertical height of said electric connector mounting slots of said housing.

5. The anti-loosening electric connector mounting structure as claimed in claim 1, wherein each said retaining arm of each said electric connector is terminated in a respective barbed hook portion for hooking on the outer surface of said peripheral wall of said housing around the respective said electric connector mounting slot.

* * * * *